US011020782B2

(12) United States Patent
Venäläinen

(10) Patent No.: US 11,020,782 B2
(45) Date of Patent: Jun. 1, 2021

(54) STRAIGHTENING APPARATUS FOR VEHICLE

(71) Applicant: Olavi Venäläinen, Kuopio (FI)

(72) Inventor: Olavi Venäläinen, Kuopio (FI)

( * ) Notice: Subject to any disclaimer, the term of this patent is extended or adjusted under 35 U.S.C. 154(b) by 155 days.

(21) Appl. No.: 16/332,119

(22) PCT Filed: Sep. 12, 2017

(86) PCT No.: PCT/FI2017/050649
§ 371 (c)(1),
(2) Date: Mar. 11, 2019

(87) PCT Pub. No.: WO2018/046805
PCT Pub. Date: Mar. 15, 2018

(65) Prior Publication Data

US 2019/0224735 A1 Jul. 25, 2019

(30) Foreign Application Priority Data

Sep. 12, 2016 (FI) ..... 20165676

(51) Int. Cl.
*B21D 1/12* (2006.01)
*B21D 1/14* (2006.01)

(52) U.S. Cl.
CPC ..... *B21D 1/12* (2013.01); *B21D 1/14* (2013.01)

(58) Field of Classification Search
CPC .. B21D 1/12; B21D 1/14; B21D 1/145; B66F 7/00; B66F 7/16; B66F 7/26; B66F 7/28
See application file for complete search history.

(56) References Cited

U.S. PATENT DOCUMENTS 2,552,974 A * 5/1951 Johnson ..... B66F 7/18 187/220
3,724,602 A * 4/1973 Hernick ..... B66F 7/18 187/216

(Continued)

FOREIGN PATENT DOCUMENTS

CN 87 1 03913 12/1987
CN 2301271 12/1998

(Continued)

OTHER PUBLICATIONS

Office Action issued in CN Appln. No. 201780065419.7 dated Jan. 22, 2020 (w/translation).

(Continued)

*Primary Examiner* — Edward T Tolan
(74) *Attorney, Agent, or Firm* — Nixon & Vanderhye P.C.

(57) ABSTRACT

The invention relates to a straightening apparatus for a vehicle, including a frame (1), a lifting device (2) fastened to the frame, a straightening table (3) which is fastened to the lifting device and which has, on its sides, platforms (5*a*1, 5*a*2, 6, 8*a*1, 8*a*2, 5, 8) onto which the vehicle may be moved for the straightening work, and anchor beams (4*a*1, 4*a*2, 4*a*3, 4*a*4; 4) and fasteners (12*a*1, 12*a*2, 13*a*1, 13*a*2; 11, 12, 13) fastened to the anchor beams for fastening the vehicle to the straightening table for the straightening work, the anchor beams (4*a*1, 4*a*2, 4*a*3, 4*a*4; 4) being fixedly fastened to the gaps between the platforms (5*a*1, 5*a*2, 8*a*1, 8*a*2, 5, 6, 8) on the sides of the straightening table (3). The inventive straightening apparatus for a vehicle includes support devices (10*a*1, 10*a*2, 10) which are settable at vehicle wheels that are between the beams (9*a*1, 9*a*2 *ja* 9*a*3, 9*a*4) at the front pan of the straightening table, below them, when the straightening table is lifted to the working height and (Continued)

Figure 1:
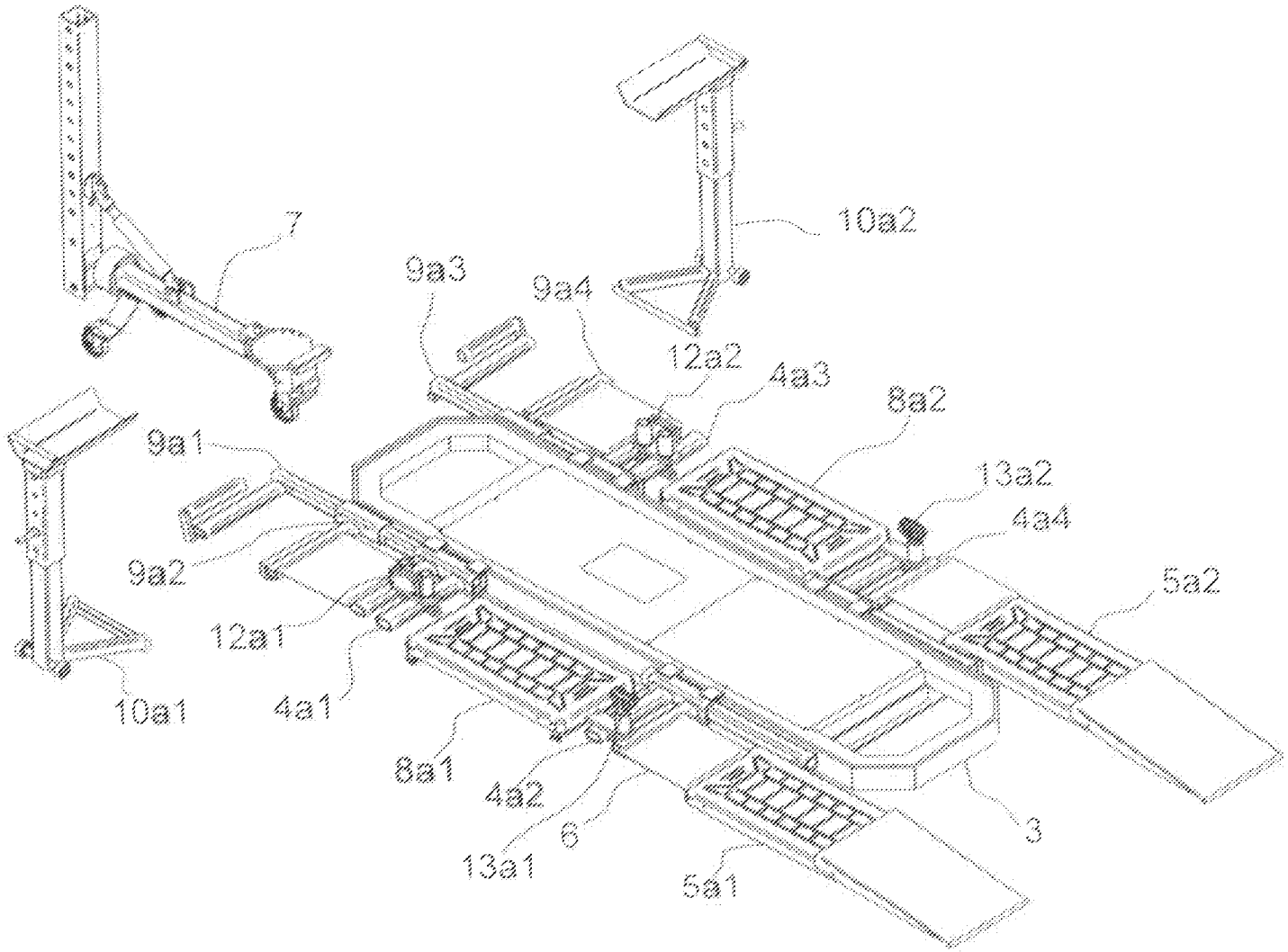

arranged to support the wheels as the straightening table and vehicle are lowered.

6 Claims, 8 Drawing Sheets

(56) References Cited

U.S. PATENT DOCUMENTS

| | | | | | |
|---|---|---|---|---|---|
| 3,789,958 | A | * | 2/1974 | Masaitis | B66F 7/26 187/216 |
| 4,070,899 | A | | 1/1978 | Venäläinen | |
| 4,086,982 | A | * | 5/1978 | Hernick | B66F 7/00 187/206 |
| 4,267,901 | A | * | 5/1981 | Tsujimura | B66F 7/025 187/204 |
| 4,289,016 | A | | 9/1981 | Hare | |
| 4,873,861 | A | * | 10/1989 | Bergstrom | B21D 1/14 72/457 |
| 4,916,933 | A | | 4/1990 | Celette | |
| 4,984,657 | A | * | 1/1991 | Burns | B66F 7/025 187/207 |
| 5,623,846 | A | | 4/1997 | Brewer, Jr. | |
| 5,634,368 | A | | 6/1997 | Venäläinen | |

FOREIGN PATENT DOCUMENTS

| | | |
|---|---|---|
| CN | 201880756 | 6/2011 |
| DE | 1 184 479 | 12/1964 |
| EP | 1 468 755 | 10/2004 |
| FI | 53930 | 5/1978 |
| FR | 2 021 194 | 7/1970 |
| GB | 1 527 556 | 10/1978 |
| JP | 60-45252 | 3/1985 |
| JP | 62-198552 | 9/1987 |
| JP | 1-109152 | 4/1989 |
| JP | 9-118206 | 5/1997 |
| JP | 2003-261010 | 9/2003 |
| JP | 2005-75604 | 3/2005 |
| KR | 10-607864 | 3/2016 |
| WO | 2017/013101 | 1/2017 |

OTHER PUBLICATIONS

Office Action issued in JP Appln. No. 2019-535982 dated Mar. 17, 2020 (w/ translation).

Search Report for FI Patent Application No. 20165676 dated Feb. 21, 2017, 1 page.

International Search Report for PCT/FI2017/050649 dated Dec. 20, 2017, 3 pages.

Written Opinion of the ISA for PCT/FI2017/050649 dated Dec. 20, 2017, 6 pages.

Search Report issued in EP Appln. No. 17848213.9 dated May 12, 2020.

* cited by examiner

STRAIGHTENING APPARATUS FOR VEHICLE

This application is the U.S. national phase of International Application No. PCT/FI2017/050649 filed Sep. 12, 2017 which designated the U.S. and claims priority to FI 20165676 filed Sep. 12, 2016, the entire contents of each of which are hereby incorporated by reference.

The invention relates to a straightening apparatus for a vehicle, including a frame, a lifting device fastened to the frame, a straightening table which is fastened to the lifting device and which has, on its sides, platforms onto which a vehicle may be moved for the straightening work, and anchor beams and fasteners fastened to the anchor beams for fastening the vehicle to the straightening table for the straightening work. The anchor beams are fixedly fastened to the gaps between the platforms on the sides of the straightening table.

When vehicles are repaired after a collision, straightening apparatuses of various kinds are used to straighten the sheet metal parts and other parts of the vehicle bodies. These straightening apparatuses have a liftable straightening table or similar, on which a vehicle is moved and to which the body of the vehicle is fastened before commencing to straighten the vehicle.

The straightening table also includes platforms on both sides thereof. When the straightening apparatus is being used, the vehicle is moved onto the straightening table through these platforms. The straightening apparatus for a vehicle also includes a lifting device by means of which the straightening table and the vehicle on it are moved in the vertical direction. Once a vehicle has been lifted upward, separate anchor beams are lifted in place and fastened to fastening points that the straightening table has. The anchor beams have separate fixtures, or such may be installed on them after the anchor beams have been installed, which are at the fastening points that the vehicle has. After this, the straightening table is lifted to a suitable height and fastened to the straightening apparatus for a vehicle by means of the fasteners of the vehicle. Following this, the straightening table for a vehicle together with the vehicle is lifted or lowered to the desired working height and the straightening work of the vehicle is commenced.

In some straightening apparatuses, the anchor beams are between the parts of the platforms and act as part of the driving platforms when a vehicle is driven onto the straightening table. The anchor beams are large and heavy beams. Usually, employees have to lift them in place and fasten them to the straightening table when a vehicle is being fastened. At this stage, the vehicle is at such a height that the lifting and fastening position is bad, and getting the anchor beams in place is slow and strenuous work that takes up a lot of working time.

The fixtures are fixedly fastened to the anchor beams, or they may be installed on the anchor beams after these have been fastened. In both cases, the fixtures are at a specific place on the anchor beams, and they may not easily be moved in the longitudinal direction of the vehicle. On different vehicles the fastening points may be at different places, so the vehicle often needs to be moved during its fastening.

It is the object of the invention to set forth a straightening apparatus for a vehicle, allowing the aforementioned drawbacks to be eliminated. In particular, the object of the invention is to set forth a straightening apparatus for a vehicle, which may be fastened to the vehicle faster than in prior art, and which is easier to use and more diverse than the prior art solutions.

The objects of the invention are achieved with the straightening apparatus for a vehicle, characterised by what is disclosed in the claims.

The inventive straightening apparatus for a vehicle includes support devices which are settable at vehicle wheels that are between the beams at the front part of the straightening table, below them, when the straightening table is lifted to the working height and arranged to support the wheels as the straightening table and vehicle are lowered. By means of the support devices, a vehicle may be supported at the fastening stage so that free space remains between the vehicle bottom and the straightening table to fasten the fasteners to the anchor beams at the fastening points of the vehicle, below them.

When the anchor beams are fixedly fastened to the gaps between the platforms on the sides of the straightening table, the anchor beams are always a fixed part of the straightening table structure, and there is no need to fasten them to the straightening table or remove them from it separately. This helps save a lot of working time and makes the straightening work faster. In addition, the employees need not find themselves in inconvenient working positions.

In a preferred embodiment of the invention, the fasteners include fastener frames that are fastened to the anchor beams movably in the longitudinal direction of the straightening table. In such a case, the fasteners may be moved at the time the vehicle is being fastened precisely at the fastening points that the vehicle has, and the vehicle may thus be fastened at exactly the right points. When the support devices allow the vehicle to be supported in place and the fastener frames may be placed at exactly the right place, it is possible to fasten the vehicle to the straightening table easily, quickly, and reliably.

In an additional preferred embodiment of the invention, the fasteners include fixtures fastened to the fastener frames.

Figure 2:
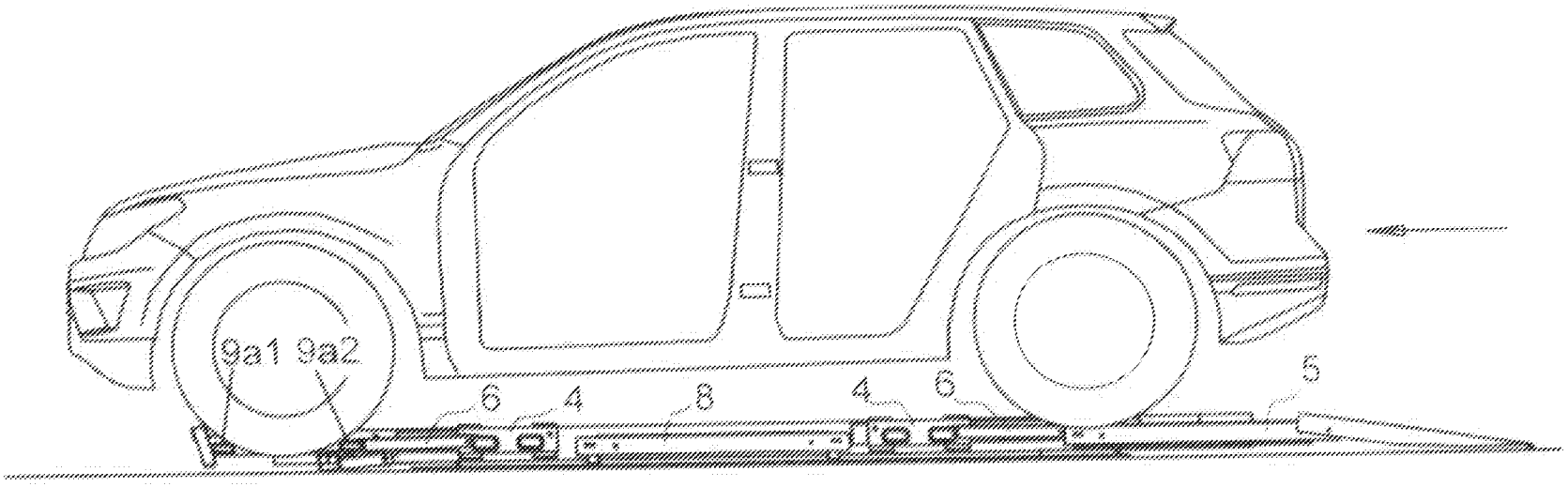
Figure 3:
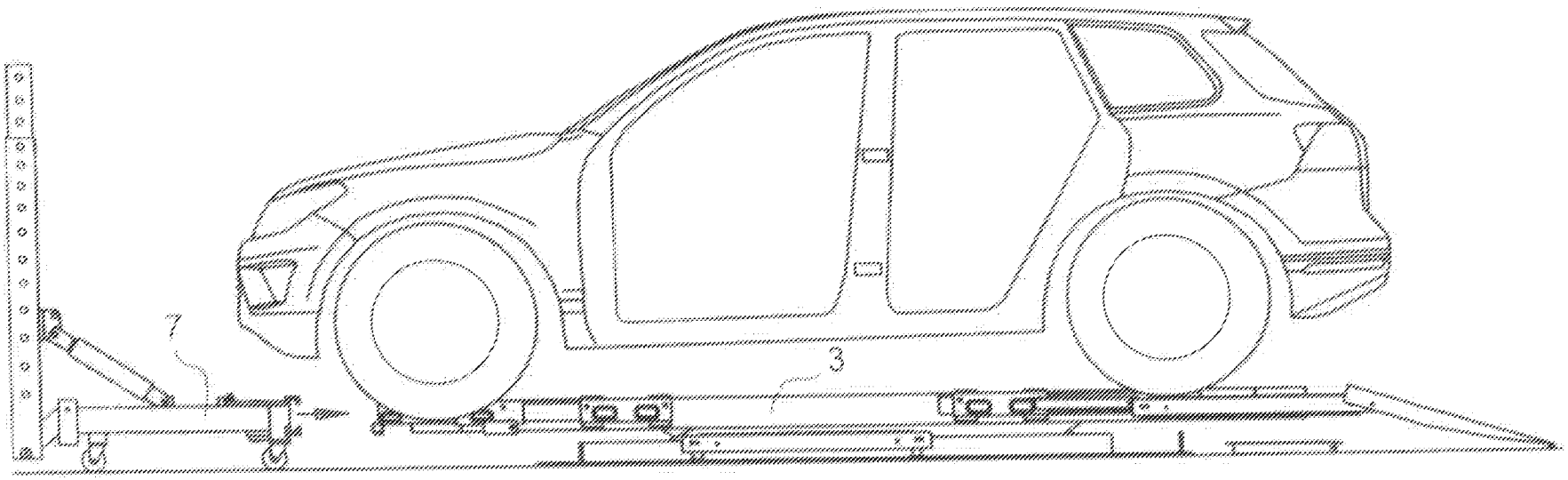
Figure 4:
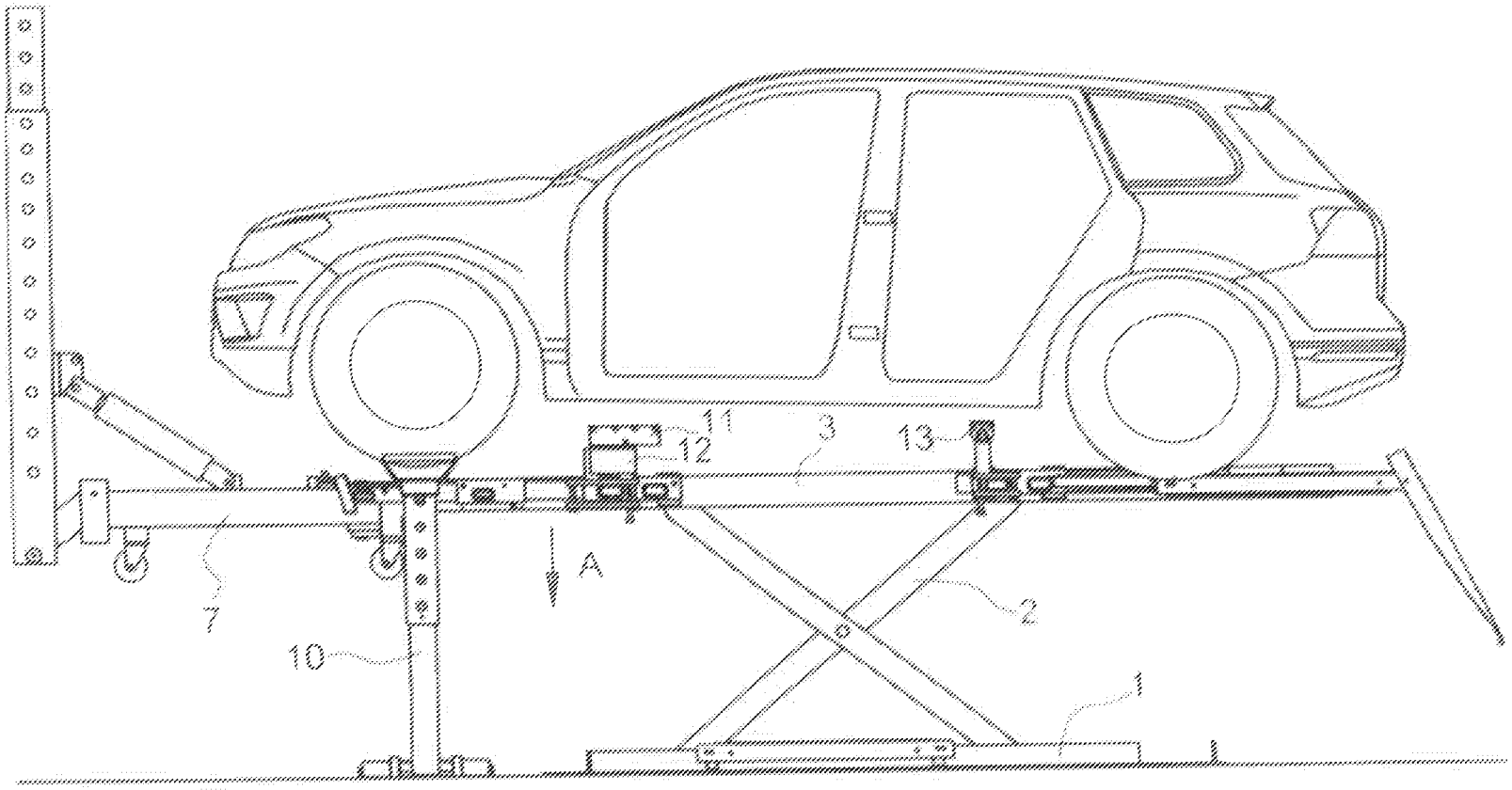
Figures 5, 6:
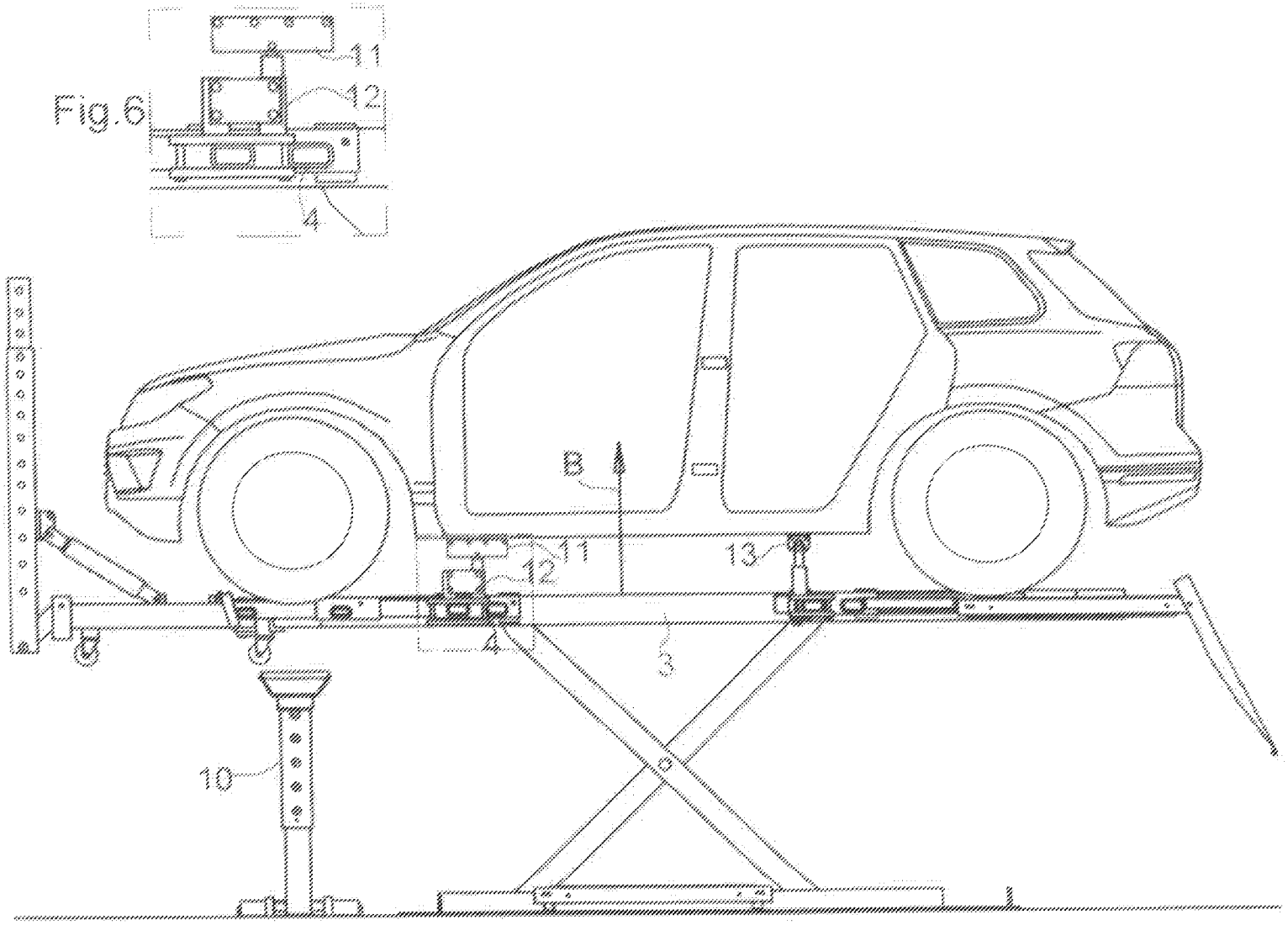
Figures 7, 8:
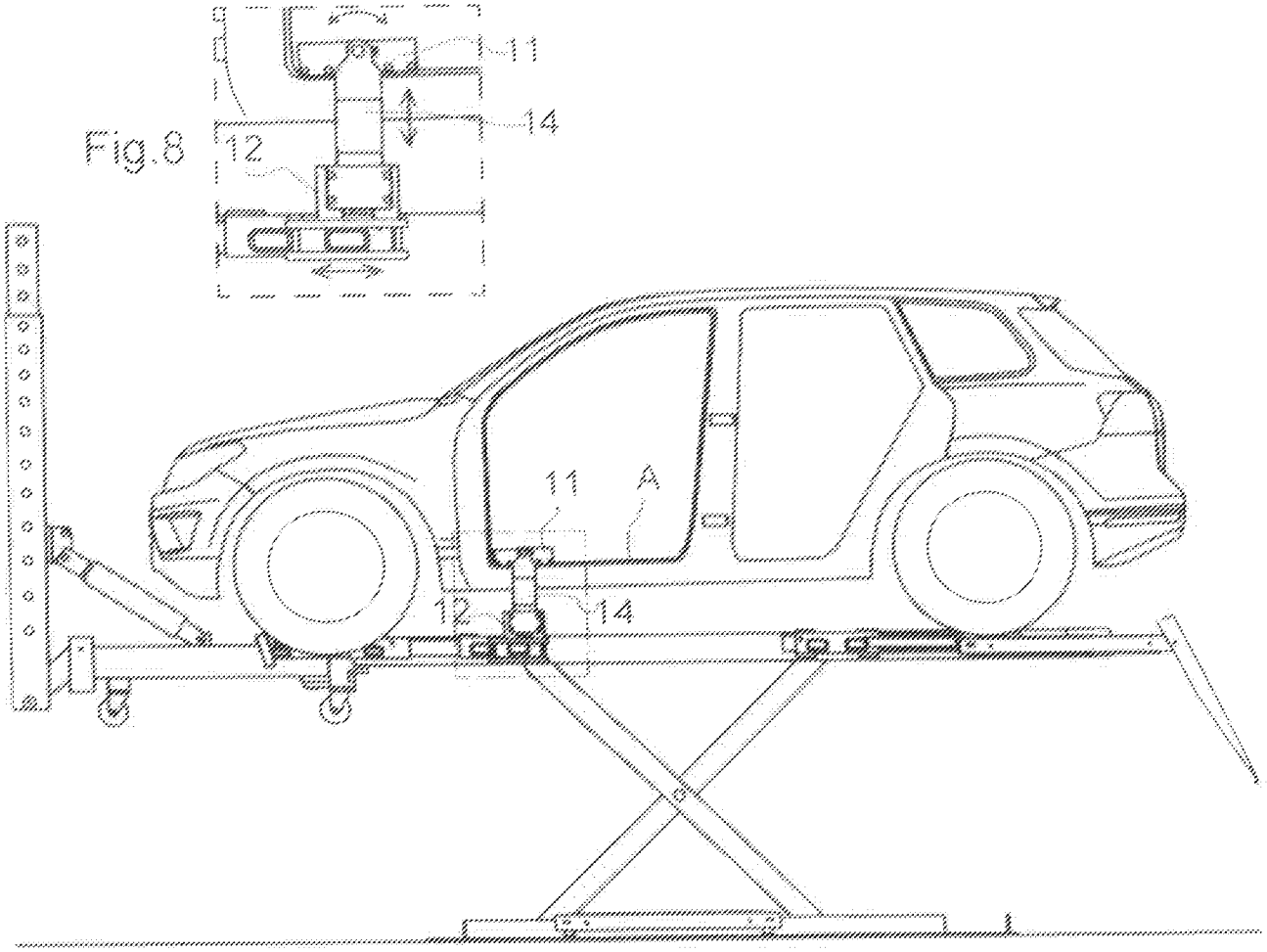
Figure 9:
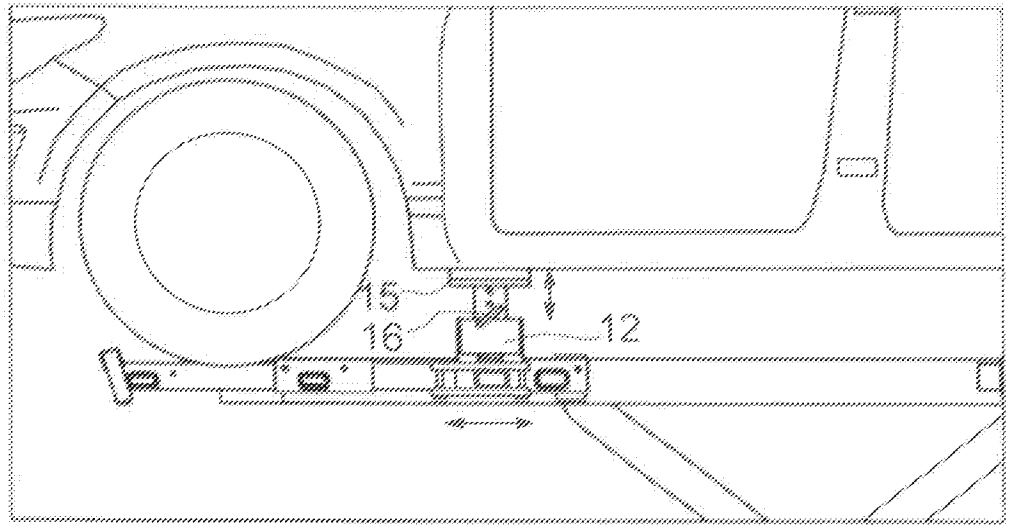
Figure 12:
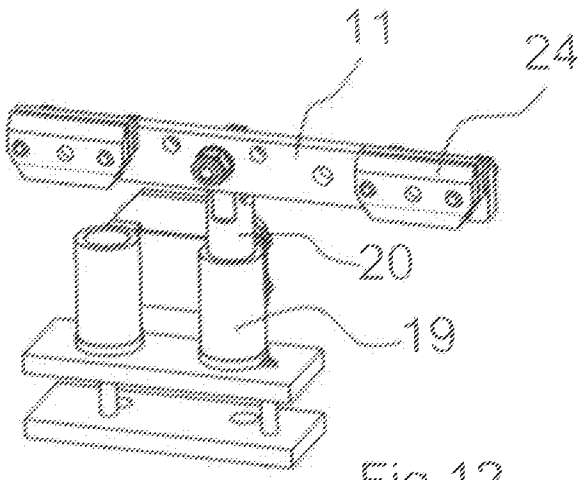
Figure 11:
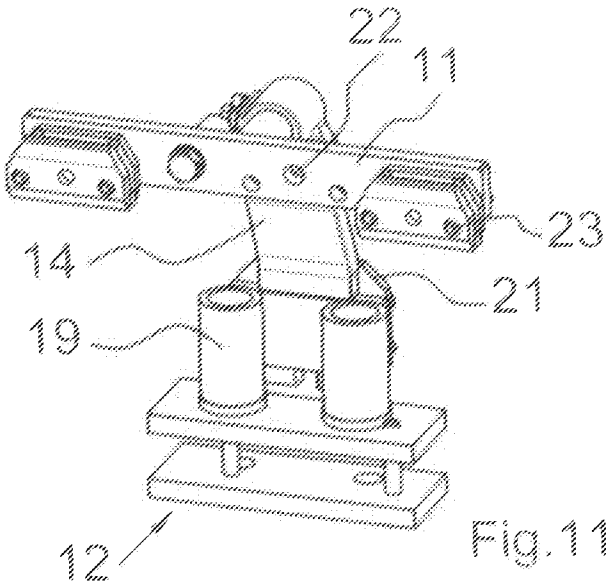
Figure 10:
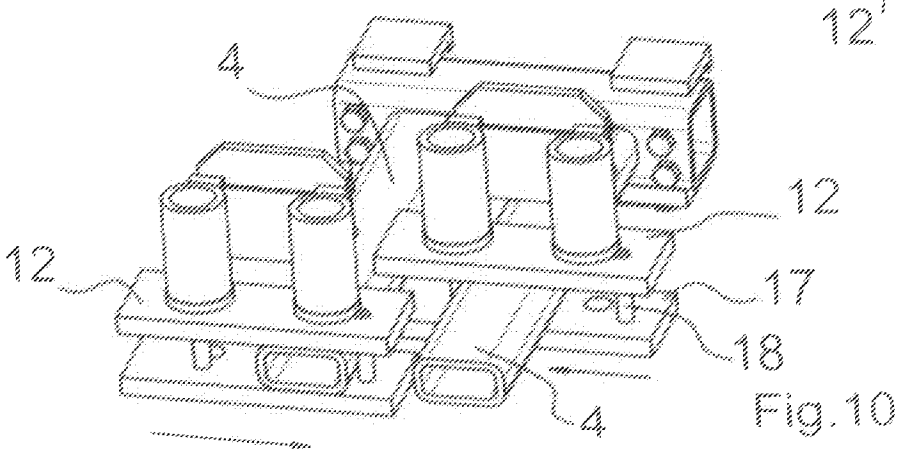

In the following, the invention will be described in greater detail with reference to the attached drawings, in which FIG. 1 is a diagonal top view of an inventive straightening apparatus for a vehicle, FIG. 2 is a side view of the straightening apparatus of FIG. 1 in the low position with a vehicle on it, FIG. 3 is a side view of the straightening apparatus of FIG. 1 lifted up from the low position with a vehicle on it, FIG. 4 is a side view of the straightening apparatus of FIG. 1 lifted to the high position with a vehicle on it, FIG. 5 is a side view of the straightening apparatus of FIG. 1 in the working position with a vehicle on it, FIG. 6 is an enlarged detail of FIG. 5, FIG. 7 is a side view of the straightening apparatus of FIG. 1 in the working position with a vehicle on it, FIG. 8 is an enlarged detail of FIG. 7, FIG. 9 is an alternative side view of using the straightening apparatus of FIG. 1 in the working position, FIG. 10 shows in detail how the fastener frames are fastened to the anchor beams, FIG. 11 shows in detail how a fastener is fastened to the upper seam of a rocker panel, and FIG. 12 shows in detail how a fastener is fastened to the lower seam of a rocker panel.

The straightening apparatus for a vehicle, in accordance with FIGS. 1 to 12, includes a frame which is on a support, a lifting device fastened to the frame, which in these figures is lifting scissors, and a straightening table fastened to the top part of the lifting scissors. On both sides of the straightening table there are platforms onto which a vehicle may be moved for the straightening work.

FIG. 1 shows the straightening apparatus and the parts and devices it includes. A straightening table 3 has on its different longitudinal sides rear platforms 5*a*1 and 5*a*2 at the rear part of the straightening table, and centre platforms 8*a*1 and 8*a*2 at the centre part. In addition, the straightening table has on its both sides, between the platforms 5*a*1 and 8*a*1 and platforms 5*a*2 and 8*a*2 removable intermediate platforms 6, and removable intermediate platforms (not shown in FIG. 1) at the front side of the centre platforms. There are gaps between the rear platforms, centre platforms, and front platforms. In these gaps, anchor beams 4*a*1, 4*a*2 have been fastened to one side, and anchor beams 4*a*3 and 4*a*4 on the other side. The anchor beams 4*a*1, 4*a*2, 4*a*3 and 4*a*4 are placed on the straightening table 3 at such places where the fastening of the vehicle to the straightening table is possible. The fastener frames are fastened to the anchor beams; the fastener frames 12*a*1 and 12*a*2 are at the front part, and the fastener frames 13*a*1 and 13*a*2 are at the rear part. In addition, the straightening apparatus according to FIG. 1 includes a separate straightening beam 7 as well as support devices 10*a*1 and 10*a*2. Further, FIG. 1 shows, at the front part of the straightening table, beams 9*a*1 and 9*a*2 on one side of the straightening table, and beams 9*a*3 and 9*a*4 on the other side for the wheels of the vehicle.

FIGS. 2 to 9 show the frame 1 on a support, lifting scissors 2 fastened to the frame, and straightening table 3 fastened to the lifting scissors. On both sides of the straightening table there are platforms 5, 6 and 8 onto which a vehicle may be moved. The figures additionally show anchor beams 4, fixedly fastened between the platforms, and fastener frames 12 fastened to them, and fixtures 11, 13 to be fastened to the fastener frames, and in FIG. 9 a lifting part 15, 16 to be fastened to the fixtures.

When using the inventive straightening apparatus for a vehicle for repairs relating to straightening the vehicle, the vehicle 3 is first moved onto the straightening table as shown in FIG. 2. The front wheels of the vehicle are then between the beams 9*a*1 and 9*a*2 at the front of the straightening table, and the rear wheels are on the platforms 5 and/or 6 at the rear. The anchor beams are in the gaps of platforms 6 and 8, and the platforms together with the anchor beams form a driving platform along which the vehicle may be driven onto the straightening table. In accordance with FIG. 3, the straightening table 3 is lifted to such an extent that the straightening beam 7 can be pushed in contact with the straightening table and fastened to the straightening table.

FIG. 4 shows a vehicle in a position where it has first been lifted, by means of the straightening table, up to such a height that the support devices 10 have been successfully placed under the wheels. After this, the straightening table has been moved downward into the position according to FIG. 4. In this position, the fastener frames 12 and the fixtures 11,13 to be fastened to them may be fastened to the anchor beams, the fasteners being at the vehicle fastening points below them.

In FIG. 5, the straightening table is shown in the following position. The straightening table has been lifted upward in the direction of the arrow B, whereby it rises above the support devices, and as the vehicle rises it fastens itself to the straightening table by means of the front fixtures 11 and rear fixtures 13. FIG. 6 shows in a larger scale the anchor beam 4, fastener frame 12 fastened on it, and rocker panel fixture 11 fastened to it.

FIGS. 7 and 8 show the fastening of a vehicle to a straightening table by making use of a double fastener 11, which is fastened to the vehicle by the upper edge A. This is used for vehicles that lack the lower edge of the rocker panel. FIG. 8 shows in a larger scale the anchor beam 4, fastener frame 12 fastened above it, and a fixture 11 fastened with an adjustable arm 14.

When a vehicle has been fastened to the straightening table as shown in FIGS. 5 to 8, the straightening work of the vehicle may start. The straightening work is carried out by means of the straightening beam 7 in a manner known per se.

FIG. 9 shows the use of the device in repair and service tasks. In such a case, a lifting part 15 has been installed to the fastener frame 12, the height of which is adjustable with a lock pin 16.

FIG. 10 shows two fastener frames 12 and their fastening to the anchor beams 4 of the straightening table. There are two beams, at a distance from each other, as the anchor beams 4. The fastener frames 12 include two plate-like parts 17 at a distance from each other, and between them, at a distance from each other, fastening screws 18. The distance between the fastening screws is larger than the width of the beams of the fastener frame. As a vehicle is being fastened, the fastener frames 12 are set to the anchor beams 4 so that the anchor beam is between the plate-like parts 17. As shown in FIG. 10, the fastener frames 12 may be moved and shifted in the longitudinal direction of the straightening table as per the arrows. Once they have been successfully set at the desired place at the fastening points of the vehicle, they may be fastened in place by means of the fastening screws 18.

FIGS. 11 and 12 show the fastener frame 12 according to FIG. 10. On the upper plate-like part of the fastener frame there are two sleeves 19, extending upward, to which the fixture 11 may be fastened by means of a tubular intermediate part 20 (FIG. 12). In addition, a fastening part 21 has been fastened to the sleeves, to which the fixture 11 may be fastened by means of a plate-like intermediate part 14 (FIG. 11). The fixture 11 is a plate-like part in the middle of which there are fastening points 22 to fasten it to the intermediate part 14 or 20 by a screw fastening. The plate-like part of the fastener has at both ends fastening members 23, 24 for fastening the fastener to the seam of the rocker panel of the vehicle. As the fastening members 23, 24, there are two plates at a small distance from each other, which may be tightened in relation to each other and meant to be placed on both sides of the vehicle seam and to be fastened/tightened to the seam.

FIG. 11 shows in detail how the fastener is fastened to the upper seam of a rocker panel. In such a case, the fixture 11 is fastened by a screw fastening to the plate-like intermediate part 14. The gap between the fastening plates extends downward and the fastening plates are clamped to the upper seam of the rocker panel of the vehicle.

FIG. 12 shows in detail how a fastener is fastened to the lower seam of a rocker panel. In such a case, the fixture 11 is fastened by a screw fastening to the tubular intermediate part 20. The gap between the fastening plates extends upward and the fastening plates are clamped to the lower seam of the rocker panel of the vehicle.

The same fastener is used for fastening the upper seam and lower seam of the vehicle. The fastener is turned to a different position when the fastening is carried out to the upper seam than to the lower seam.

The invention is not restricted to the preferred embodiments disclosed in the above, but it may vary within the scope of the inventive idea defined in the claims.

The invention claimed is:

1. A straightening apparatus for a vehicle, including a frame, a lifting device fastened to the frame, a straightening table which is fastened to the lifting device and which has, on its sides, platforms onto which the vehicle may be moved for the straightening work, and anchor beams and fasteners fastened to the anchor beams for fastening the vehicle to the straightening table for the straightening work, the anchor beams being fixedly fastened, in gaps between the platforms, to the sides of the straightening table, and beams at a front part of the straightening table, wherein the straightening apparatus for a vehicle includes support devices which are settable under the vehicle wheels that are between the beams at the front part of the straightening table when the straightening table is lifted to the working height and arranged to support the wheels as the straightening table and vehicle are lowered.

2. A straightening apparatus for a vehicle as claimed in claim 1, wherein the fasteners include fastener frames that are fastened to the anchor beams movably in a longitudinal direction of the straightening table.

3. A straightening apparatus for a vehicle as claimed in claim 1, wherein the fasteners include fixtures that are fastened to the fastener frames.

4. A straightening apparatus for a vehicle as claimed in claim 3, wherein the fastener frame includes a support part for fastening the fixture.

5. A straightening apparatus for a vehicle as claimed in claim 2, wherein the fastener frames include two planar parts at a distance from each other, and between them, at a distance from each other, fastening screws.

6. A straightening apparatus for a vehicle as claimed in claim 5, wherein a distance between the fastening screws is larger than a width of the anchor beams.

* * * * *